US006704990B2

(12) United States Patent
Kleinikel et al.

(10) Patent No.: US 6,704,990 B2
(45) Date of Patent: Mar. 16, 2004

(54) METHOD OF MAKING CHAIR BASE

(75) Inventors: Manfred Kleinikel, Ahlen (DE); Helmut Berkenkoetter, Oelde (DE); Walter Mersmann, Ahlen (DE)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 10/411,523

(22) Filed: Apr. 10, 2003

(65) Prior Publication Data

US 2003/0189143 A1 Oct. 9, 2003

Related U.S. Application Data

(62) Division of application No. 09/906,029, filed on Jul. 13, 2001, now Pat. No. 6,626,404.

(51) Int. Cl.[7] ..... B21D 39/02; B21D 39/03; B23P 11/00; F16M 11/14

(52) U.S. Cl. ..... 29/463; 29/428; 29/432; 248/188.1

(58) Field of Search ..... 29/463, 428, 432; 248/188.1, 188.7, 129, 364.01, 519; 16/38; 297/440.1, 440.23

(56) References Cited

U.S. PATENT DOCUMENTS

| | | | | |
|---|---|---|---|---|
| 1,635,389 A | * | 7/1927 | Shuffleton | 16/29 |
| 1,922,099 A | | 8/1933 | Kilian | |
| 2,218,583 A | | 10/1940 | Marthaler | |
| 2,913,208 A | | 11/1959 | McKinley | |
| 3,018,506 A | | 1/1962 | Haydock | |
| 3,186,064 A | | 6/1965 | Buhrmaster | |
| 3,186,669 A | | 6/1965 | Buhrmaster | |
| 3,391,887 A | | 7/1968 | Doerner | |
| 3,452,386 A | | 7/1969 | Carlson | |
| 3,478,381 A | | 11/1969 | Schultz, Jr. | |
| 3,487,495 A | | 1/1970 | Schultz, Jr. | |
| 3,682,425 A | | 8/1972 | Vincent et al. | |
| 3,801,054 A | | 4/1974 | Glowacki | |
| 3,908,946 A | | 9/1975 | George et al. | |
| 4,027,364 A | | 6/1977 | Saam | |
| 4,084,776 A | | 4/1978 | Cook | |
| 4,262,871 A | | 4/1981 | Kolk et al. | |
| 4,412,667 A | | 11/1983 | Doerner | |
| 4,598,892 A | | 7/1986 | Franckowiak et al. | |
| 4,653,710 A | | 3/1987 | Dickison | |
| 4,712,758 A | | 12/1987 | Cuschera | |
| 4,731,900 A | | 3/1988 | Frobose | |
| 4,821,986 A | | 4/1989 | White | |
| 4,911,391 A | | 3/1990 | Ellis | |
| 4,984,761 A | | 1/1991 | Chen | |
| 5,048,780 A | | 9/1991 | Borsani | |
| 5,137,237 A | | 8/1992 | Haskins | |
| 5,149,035 A | | 9/1992 | Bonnema et al. | |
| 5,249,768 A | | 10/1993 | Edwards et al. | |
| 5,288,045 A | | 2/1994 | Edwards et al. | |

(List continued on next page.)

*Primary Examiner*—John C. Hong
(74) *Attorney, Agent, or Firm*—Flynn, Thiel, Boutell & Tanis, P.C.

(57) ABSTRACT

A chair base includes a rigid base member having a plurality of elongate tubular leg members disposed angularly around and radiating outwardly from a central hub. Each leg member adjacent an outer free end thereof has a hub structure defining a through vertical bore for retaining the pintle of a caster. The hub structure includes coaxially aligned upper and lower sleevelike hub parts which are monolithically and integrally joined to and extruded transversely into the interior of the leg member from the respective top and bottom walls thereof. The pintle-retaining hub structure is formed by a pierce-and-extrude process whereby small pilot openings are initially formed through the respective walls, and the annular wall portion surrounding the respective pilot opening is thereafter transversely extruded to effect forming of the respective hub part. The pierce-and-extrude process for each hub part is, in a preferred process, carried out by a single forming tool.

12 Claims, 6 Drawing Sheets

U.S. PATENT DOCUMENTS

| | | | |
|---|---|---|---|
| 5,402,973 | A | 4/1995 | Haines |
| 5,745,951 | A | 5/1998 | Waner |
| 5,752,684 | A | 5/1998 | Larkin |
| 5,906,343 | A | 5/1999 | Battey et al. |
| 5,964,436 | A | 10/1999 | Battey et al. |
| 6,059,239 | A | 5/2000 | Wheeler |
| 6,290,191 | B1 | 9/2001 | Hendricks et al. |

* cited by examiner

METHOD OF MAKING CHAIR BASE

This is a divisional of Ser. No. 09/906,029, filed Jul. 13, 2001 now U.S. Pat. No. 6,626,404.

FIELD OF THE INVENTION

This invention relates to a chair base having improved manufacturability and reduced cost, particularly with respect to the caster pintle mount provided adjacent the ends of the base legs.

BACKGROUND OF THE INVENTION

Chairs as typically used in offices and the like often include bases having radially extending legs with casters at their ends for movably supporting the chair. To provide the necessary strength and durability, it is conventional to form a unitary base member constructed of steel, with a plurality of legs (typically five) disposed angularly around and radiating outwardly from a center hub. The inner ends of the legs are typically welded to the hub, and the outer ends of the legs are typically provided with a support sleeve associated therewith for retention of the caster pintle. In recent years it has been a common practice to form the individual legs from a flat platelike steel blank which is deformed to define an elongate tubular construction, whereby one end thereof is welded to the center hub, and the other end is subjected to suitable manufacturing processes so as to permit a separate pintle-accommodating support sleeve to be fixedly secured thereto, such as by welding. Alternatively, in some applications the caster pintle is accommodated in openings formed in the leg member and is then directly welded to the base member. In most applications, the unitary steel base member is thereafter provided with a cover disposed thereover to provide the base assembly with desired aesthetics. While a base assembly of the above type, and specifically a unitary steel base member of the above construction provides desirable strength and durability, nevertheless the overall manufacture thereof is relatively complex and costly due to the numerous parts and forming steps associated therewith.

Accordingly, it is an object of this invention to provide an improved chair base, specifically a unitary steel base member which improves on both the construction of the base and the manufacturing process thereof so as to result in a base which possesses desired strength and durability but which can be manufactured utilizing fewer parts and which permits manufacture to be carried out more efficiently so that the overall base member is less costly.

According to the present invention, the individual leg of the base member is defined by an elongate tubular member which adjacent one end thereof is provided with upper and lower sleevelike hubs which are integrally and monolithically joined to the respective upper and lower walls of the leg member and which project coaxially inwardly of the leg member toward one another. These coaxially aligned hubs define an opening, preferably a cylindrical opening, which extends vertically through the leg member and permits the pintle of a caster to be snugly and durably supported therein, whereby provision of a separate pintle-retaining sleeve is not required.

In the improved base member of this invention, as aforesaid, the upper and lower walls of the leg member are initially provided with small pilot openings formed therethrough, which openings are of smaller cross section than the caster pintle. The wall material surrounding the pilot openings is then physically deformed (extruded) transversely into the interior of the leg member, such as by an extruding tool, and is reshaped into an annular sleevelike hub which projects generally transversely from the respective wall through a selected distance into the interior of the leg member. The annular hubs as deformed from the upper and lower walls are disposed in coaxially aligned and opposed relationship to define a pintle-accommodating opening which extends vertically through the leg member.

According to the present invention, the manufacturing process for the leg member of the unitary base includes the steps of forming small pilot holes through the top and bottom walls of the leg member, and reshaping the annular wall material surrounding each preformed pilot opening so as to result in formation of an annular pintle-accommodating hub which is integrally and monolithically joined to and projects inwardly from the respective top and bottom wall, whereby the pintle-accommodating hubs define therein a cross sectional opening which is greater in size than the respective pilot opening as originally formed in the respective top and bottom wall. The aforementioned manufacturing process can be carried out by a first tool which forms the pilot opening followed by application of a second tool which extrudes the surrounding annular wall so as to define the hub. In the alternative, the process can be carried out by a single tool which initially preforms the pilot opening and thereafter immediately follows up with the extrusion of the annular wall portion so as to permit formation of the annular pintle-accommodating hub.

These and other features and advantages of the present invention will be appreciated and understood by those skilled in the art upon reading the following specification and inspecting the accompanying drawings, and with reference to the appended claims.

Certain terminology will be used in the following description for convenience and reference only, and will not be limiting. For example, the words "upwardly", "downwardly", "rightwardly" and "leftwardly" will be used with reference to the invention as appearing in the attached drawings, and the words "upwardly" and "downwardly" will also be used with reference to the conventional orientation of the chair and the associated base member. The words "inwardly" and "outwardly" will refer to directions toward and away from, respectively, the geometric center of the base member and designated parts thereof. Said terminology will include the words specifically mentioned, derivatives thereof, and words of similar import.

DETAILED DESCRIPTION

Figure 1:
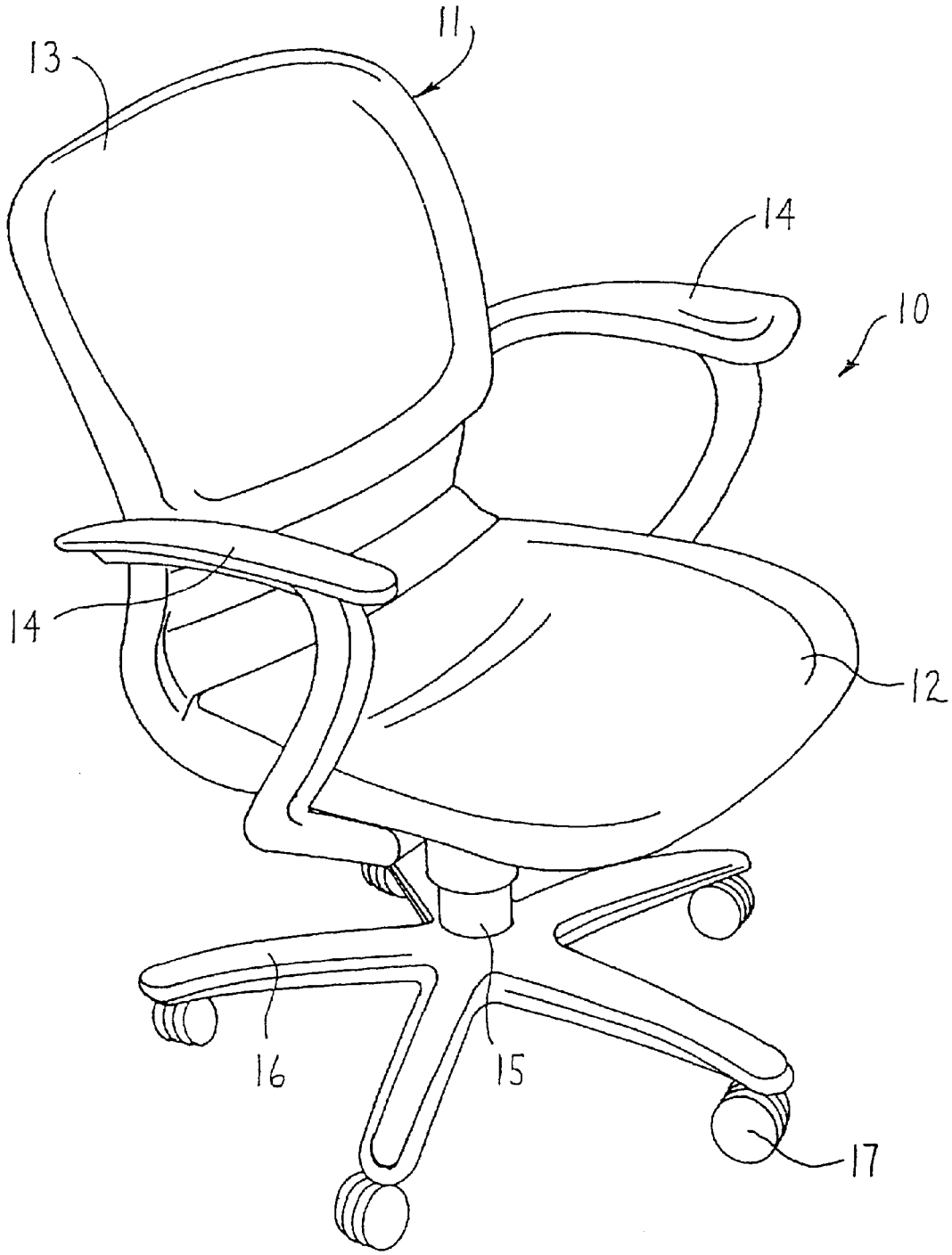
FIG. 1 (PRIOR ART)
FIG. 1 is a perspective view of a prior art office type chair.
Figure 2:
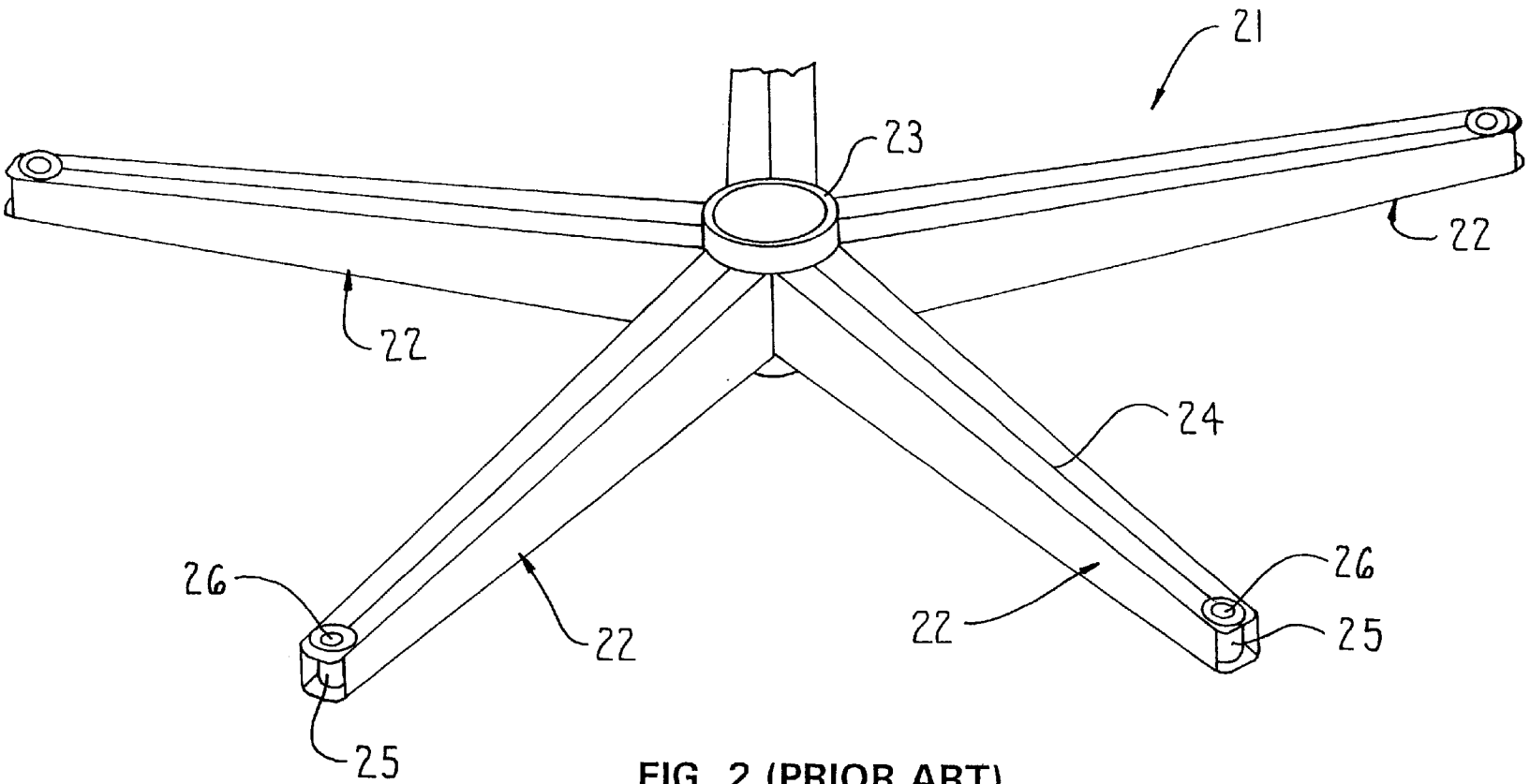
FIG. 2 (PRIOR ART)
FIG. 2 is a perspective view of a prior art unitary base member for a chair.

Referring to the drawings, FIG. 1 illustrates a prior art chair of the type conventionally utilized in offices and the like, and FIG. 2 shows a prior art unitary base member of the type conventionally utilized on chairs and employing as a part thereof separate support sleeves for accommodating the caster pintles. The chair of FIG. 1 and the base member of FIG. 2 are briefly described herein to provide appropriate background information.

The chair 10 shown in FIG. 1 includes a seat arrangement 11 having a seat 12 and an upright back 13. Arms 14 are typically provided adjacent opposite sides of the seat 12 for occupant comfort. The seat arrangement 11 couples to the upper end of an upright or pedestal 15 which is positioned beneath the seat 12. The connection between the seat arrangement 11 and the pedestal 15 conventionally comprises a tension and/or tilt control mechanism so as to permit the back and/or seat to vertically tilt either individually or jointly. The pedestal 15 typically employs a height-adjusting mechanism, such as a mechanical lift mechanism or a pneumatic lift cylinder, and the lower end of the pedestal connects to the center of a multi-leg base assembly 16, the latter being typically provided with casters 17 mounted on and protruding downwardly from the outer free ends of the legs so as to provide rolling support for the chair.

The overall construction of the chair 10 as described above is typical of one of many different types of chairs of this general category, and it will be appreciated that many different configurations and structural and operational variations, all well known in the art, can be provided and utilized in association with the chair.

One type of base member which is known in the industry and is utilized for support of chairs is illustrated in FIG. 2. The chair base member 21 illustrated by FIG. 2 is a rigid unitary base member constructed of steel and includes a plurality of generally horizontally elongate legs 22, typically five such legs, disposed in uniformly angularly spaced rerlationship around and radiating outwardly from a rigid center hub 23, typically a cylindrical hub. Each leg 22 is formed as an elongate hollow tubular member having a generally rectangular cross section, with the leg in the illustrated arrangement being initially formed from a flat blank of steel sheet and then being suitably bent or shaped to define a tubular cross section. The free edges of the blank are normally disposed so as to abut substantially as indicated at 24, with these edges being positioned to extend longitudinally substantially along the centerline of the top wall of the leg. The abutting edges 24 are typically fixedly secured by a weld which extends along the abutting edges, or by a series of spot welds positioned along the abutting edges. The top and bottom walls of each leg 22, adjacent the outer free end thereof, are provided with suitable aligned openings therein which permit a support sleeve 25 to be accommodated within these openings, whereby the support sleeve 25 extends interiorly vertically across the leg, and the upper and lower ends of the support sleeve 25 are fixedly secured to the respective top and bottom walls of the leg member, such as by welding. While it has been suggested that the support sleeve can be secured to the upper and lower walls of the leg member by other mechanical means such as metal deformation, nevertheless it has been observed that such proposals have been of questionable reliability and hence such techniques have traditionally also utilized spot welding to ensure proper securement of the support sleeve to the leg member. The support sleeve 25 defines a generally cylindrical opening 26 extending vertically therethrough, which opening accommodates a conventional elongate cylindrical pintle (or stem) associated with a conventional caster in a manner which is well known in the art.

The unitary steel base member 21 of FIG. 2, when provided with five radiating legs as is conventional, is typically constructed from a large number of individual preformed components, i.e., a center hub, five leg members, and five support sleeves, which must be assembled and thereafter fixedly secured together, typically all welded together. This base member, when utilized as part of a chair, is then typically enclosed, at least on the sides and upper surfaces thereof, by a one-piece or multiple-piece cover arrangement so as to provide the desired aesthetics. Such cover arrangements are well known and commonly utilized in the chair industry.

Reference will now be made to FIGS. 3–10 which illustrate therein an improved unitary chair base member according to the present invention, and in particular an improved chair leg for use with a chair base.

Figure 3:
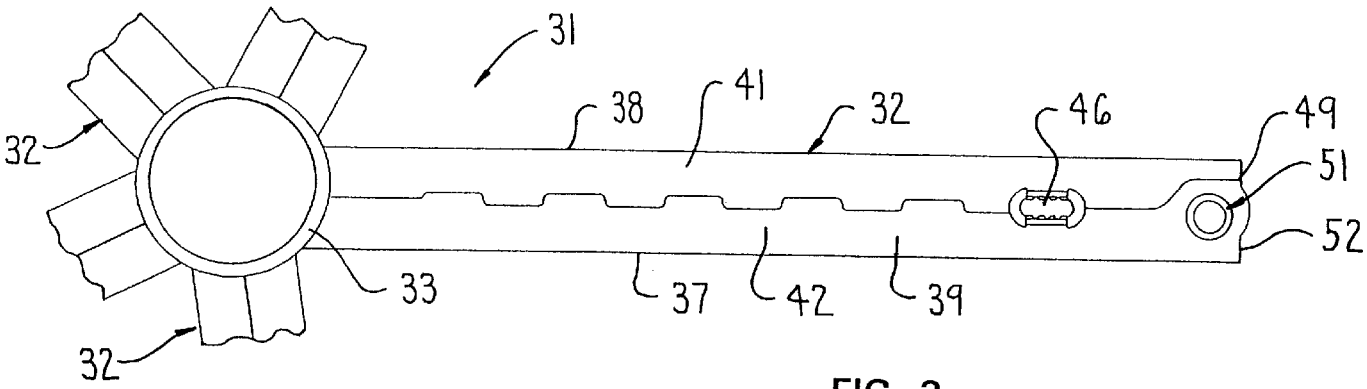
FIG. 3 is a fragmentary top view of a unitary base member according to the present invention.

FIG. 3 illustrates a unitary and rigid chair base member 31 which incorporates therein the improved leg 32 of the present invention. A plurality of such legs 32, typically five such legs, are disposed in uniform angularly spaced relationship around and project radially outwardly from a central hub 33, the latter typically being a cylindrical steel sleeve or tube. The legs 33, at their inner ends, are fixedly secured relative to the hub 33 in a conventional fashion, typically by welds which extend circumferentially around the hub along the top and bottom walls of the legs, and/or by welds which extend vertically of the hub along the vertical edges of the leg sidewalls. This general construction is conventional.

Figure 4:
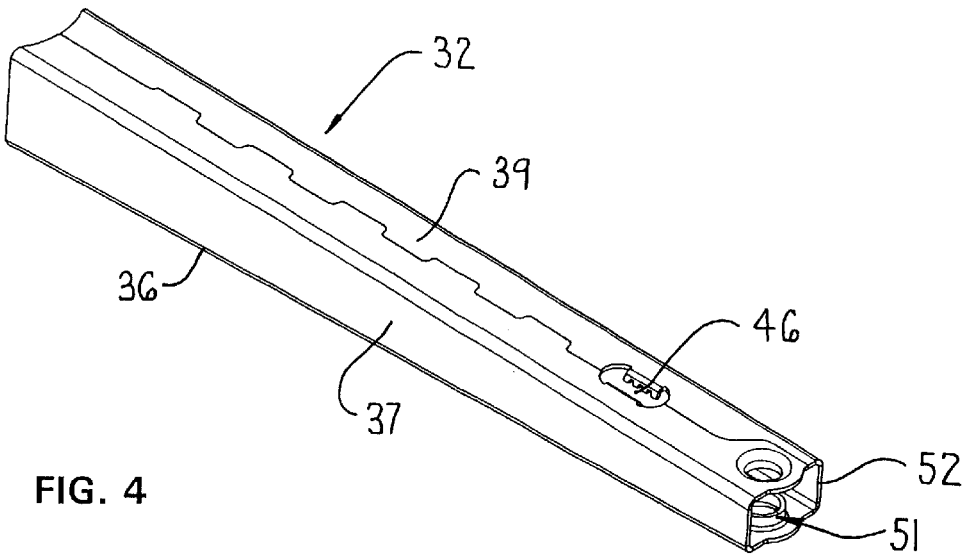
FIG. 4 is a perspective view of a leg member according to the invention.
Figure 7:
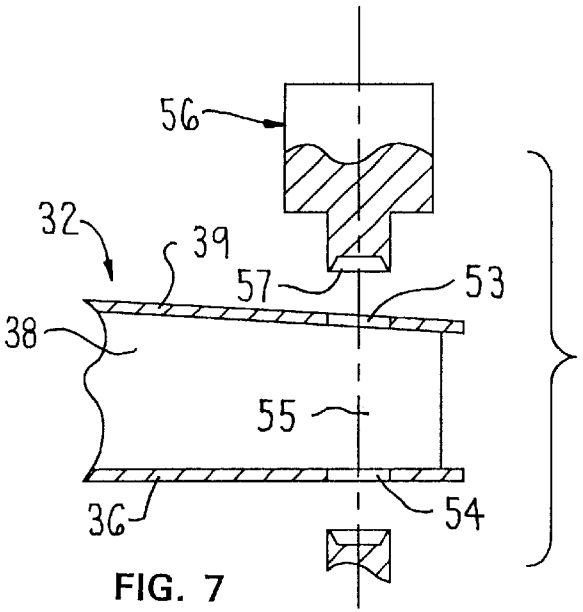
FIG. 7 is a sectional view taken along line 7—7 in FIG. 6 and illustrating the first forming step.
Figure 6:
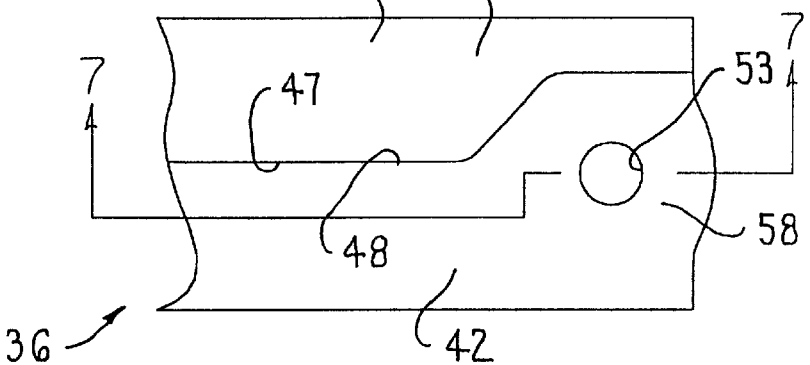
FIG. 6 is a fragmentary top view showing the end of the leg member during a first step for forming the caster pintle hub arrangement.
Figure 5:
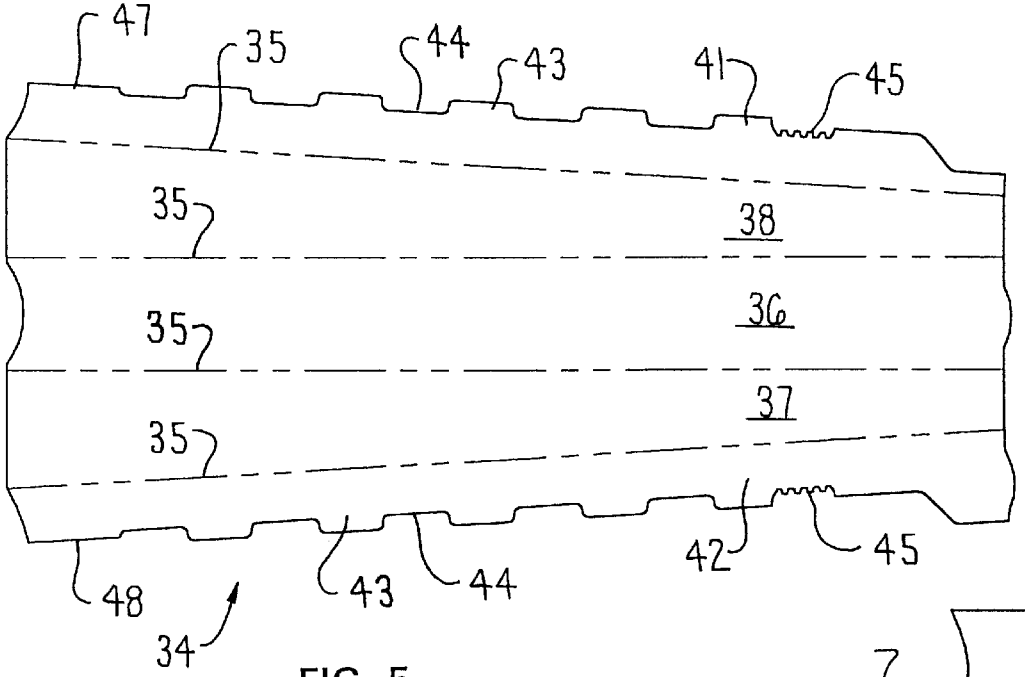
FIG. 5 illustrates a flat steel blank utilized for forming the elongate tubular leg illustrated in FIGS. 3–4.

The improved leg member 32 of the present invention as illustrated in FIG. 4 is constructed in its entirety from a one-piece flat blank 34 (FIG. 5) of sheet steel which is suitably bent (i.e. stamped) to define an elongate tubular member of generally rectangular configuration. The flat leg blank 34 in particular is bent or deformed generally about a plurality of corner bend lines 35 so that the blank, when bent into a tubular configuration to define the leg, possesses a bottom wall 36, a pair of sidewalls 37–38, and a top wall 39. The forming of the edge blank 34 is such that edge wall parts 41 and 42 thereof, during the forming of the blank into the tubular cross section, are substantially coplanar and have their free edges 47–48 disposed in abutting engagement approximately along the longitudinal center of the top wall. These edge wall parts 41 and 42 thus define the top wall 39 of the leg member in the assembled condition. The edge wall parts 41 and 42, along the abutting edges thereof, may be suitably fixedly secured such as by a series of longitudinal spot welds if necessary.

In the illustrated and preferred embodiment, the free edges 47–48 of the edge parts 41 and 42 are each provided with a longitudinal series of alternating teeth 43 and notches 44 positioned so as to effectively interfit with one another during forming of the tubular leg member, thereby providing overall strength and rigidity to the tubular leg member.

The leg blank 34 is also provided with a notch 45 which opens inwardly from each of the free edges 47–48 thereof in spaced relationship from the outer end thereof such that, when the blank is folded into and defines the formed tubular leg member 32, the notches 45 register with one another and thus define an opening 46 through the top wall 39. The opening 46 is typically disposed generally along the longitudinal center of the top wall and is provided to accommodate therein a downwardly projecting lug associated with a conventional cover which fits over the base member. The opening 46 for the lug on the cover, however, can be eliminated if desired, or positioned at other locations, depending on the design of the cover and its overall relationship to the base member.

To permit the leg member 32 of this invention to mount thereon a conventional caster, the leg member 32 is provided with a hub arrangement 51 for accommodating therein the stem or pintle of a conventional caster. This hub arrangement 51 is disposed adjacent the outer free end 52 of the leg member, and is monolithically formed from the same material defining the leg blank 34, as described hereinafter.

During forming of the leg member 32, pilot openings 53 and 54 (FIGS. 6 and 7) are formed through the respective top and bottom walls 39 and 36 adjacent the free end 52 of the leg member 32. The openings 53 and 54 align with one another along a generally vertically extending axis 55, and preferably define small circular openings having a diameter which is substantially smaller than the diameter of the caster pintle which is to be associated with the chair base. The openings 53–54 may be formed by a suitable forming tool 56, such as a tool having a forming punch or pierce 57 provided on the end thereof so as to effect creation of the opening 53 or 54 in the respective wall.

After the pilot holes 53–54 have been preformed in the respective top and bottom walls of the leg member, the annular band of wall material 58 which surrounds each of the holes 53–54 is then transversely deformed (as described below) inwardly into the interior of the tubular leg member so as to define coaxially aligned upper and lower hub or sleeve parts 61 (FIGS. 8 and 9) which project into the interior of the tubular leg member in opposed relationship to one another and which are integrally and monolithically joined to the respective top wall 39 and bottom wall 36.

Each of the hub parts 61 is joined to its respective top or bottom wall through an appropriate rounded corner 62, from which the hub 61 projects interiorly of the leg member over a selected axial extent so as to define therein an inner cylindrical wall 63 having a diameter which significantly exceeds the diameter of the pilot openings 53–54. The diameter of the inner cylindrical wall 63 preferably substantially equals or is sized to correspond with the diameter of the caster pintle or stem so that the latter can be inserted therein and fixedly and stably supported. The inner cylindrical walls 63 associated with the upper and lower hub parts 61 are normally of the same diameter, and are coaxially aligned generally along a vertical axis 65 so as to effectively define a generally cylindrical bore 64 extending vertically through the tubular leg member 32 adjacent the outer end 52 thereof.

Figure 9:
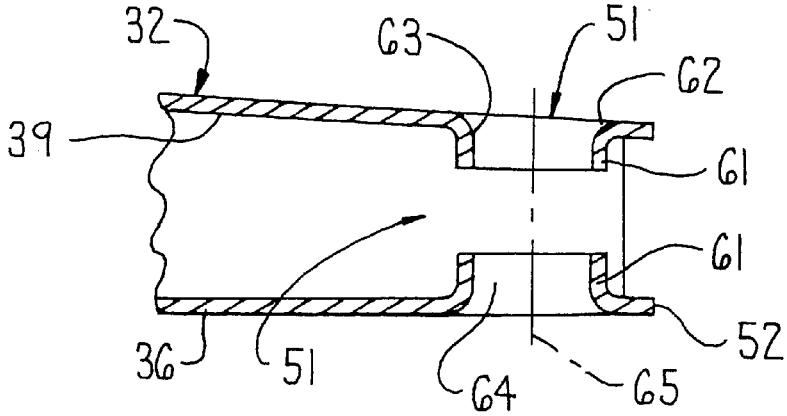
FIG. 9 is a sectional view taken along line 9—9 in FIG. 8 and illustrating the pintle hub arrangement.

As illustrated in FIG. 9, the opposed hub parts 61 are cantilevered interiorly of the leg member so that the free ends of the hub parts are normally spaced vertically from one another.

Figure 8:
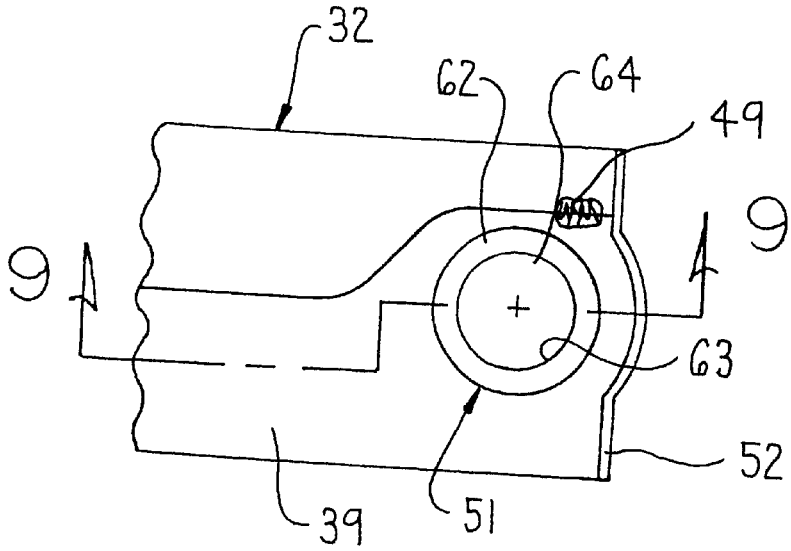
FIG. 8 is a fragmentary top view like FIG. 6 but showing the formed pintle hub arrangement following a second forming step.
Figure 10:
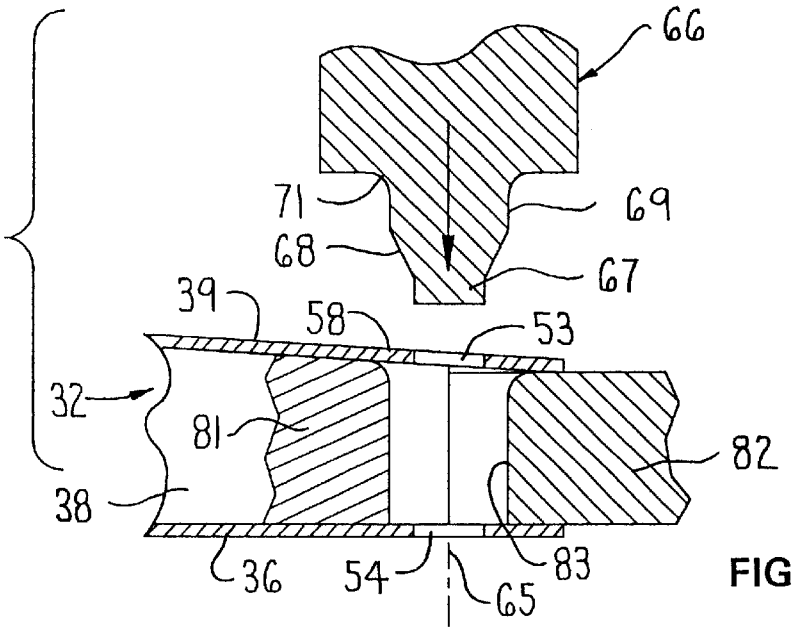
FIG. 10 is a diagrammatic sectional view illustrating the forming of the pintle hub arrangement.

The upper and lower hub parts 61 may be formed by means of suitable forming tools, such as diagrammatically illustrated at 66 in FIG. 10. The forming tool 66 includes a pilot end 67 sized to permit entry into the respective pilot hole 53–54. The pilot end 67 is axially followed by an exterior flared (preferably conical) forming surface 68 which, at its maximum diameter end, joins axially to an exterior cylindrical forming surface 69, the latter terminating at a rounded interior corner 71 which joins to the main body of the forming tool. With this relationship, insertion of the forming tool 66 into the pilot opening 53 or 54, and the subsequent axial movement of the forming tool relative to the leg member along the axis 55, causes the annular band of wall material 58 surrounding the pilot opening to engage the conically flared forming surface 68 so that this band of material is initially deformed transversely relative to the respective top or bottom wall into the interior of the leg member and to initially assume a generally tapered truncated conical shape. The continued axial inward movement of the forming tool then causes the cylindrical forming surface 69 to engage the tapered preformed wall formed by the flared forming surface 68, with the tapered wall as it progressively engages the cylindrical forming surface 69 then being further deformed until the cylindrical forming surface 69 causes the wall material to assume a generally cylindrical configuration of uniform interior diameter. The inward movement of the forming tool 66 continues until the rounded interior corner 71 thereon effects formation of the rounded corner 62 where the hub part 61 joins to the respective top or bottom wall. The forming tool is thereafter withdrawn, thereby resulting in formation of the hub part 61 having the configuration as illustrated by FIGS. 8 and 9.

The upper and lower hub parts 61 may be simultaneously formed by means of opposed upper and lower forming tools which are simultaneously moved inwardly and substantially simultaneously engage and effect deformation of the wall material surrounding the pilot openings formed in the upper and lower walls of the leg member. It will be appreciated, however, that the upper and lower hub parts can be formed sequentially, rather than simultaneously, if desired.

While the manufacturing process as described above illustrates use of a first forming tool 56 for effecting forming of the pilot openings 53–54 and use of a second forming tool 66 to effect formation of the hub parts 61, it will also be appreciated, and in fact such is believed preferred, that the two forming tools can be incorporated into a single tool so that both the pilot hole and the deformed hub part can be sequentially created by a single tool associated with each of the top and bottom walls of the chair leg member. For example, the pilot end of the forming tool 66 can be provided with a punch (such as the punch 57) associated therewith so as to initially effect creation of the pilot opening, with the continued inward movement of the modified forming tool 66 thereafter effecting forming of the appropriate hub part 61.

After each tubular leg member 32 has been processed so as to permit formation of an integral and monolithic pintle-hub arrangement 51 adjacent the free end 52 thereof, and has also been appropriately secured (for example welded) to the hub 33 so as to create the unitary multi-leg base member 31, a caster (FIG. 11) can be mounted on each of the legs adjacent the free end thereof. For this purpose the conventional caster has an upwardly projecting and cantilevered stem or pintle 76 which is typically of an elongate cylindrical configuration, sometimes with steps or undercuts associated therewith, and this pintle 76 is sized so that it can be vertically inserted upwardly into the cylindrical bore 64 defined by the upper and lower hub parts 61, with the latter hub parts creating upper and lower spaced annular bands of secure engagement with the caster pintle to fixedly and securely retain the caster pintle to the chair base. The pintle conventionally has a resilient retaining ring therearound which can pass upwardly through the lower hub part 61 and then radially expand so as to axially retain the pintle within the hub arrangement.

Figure 11:
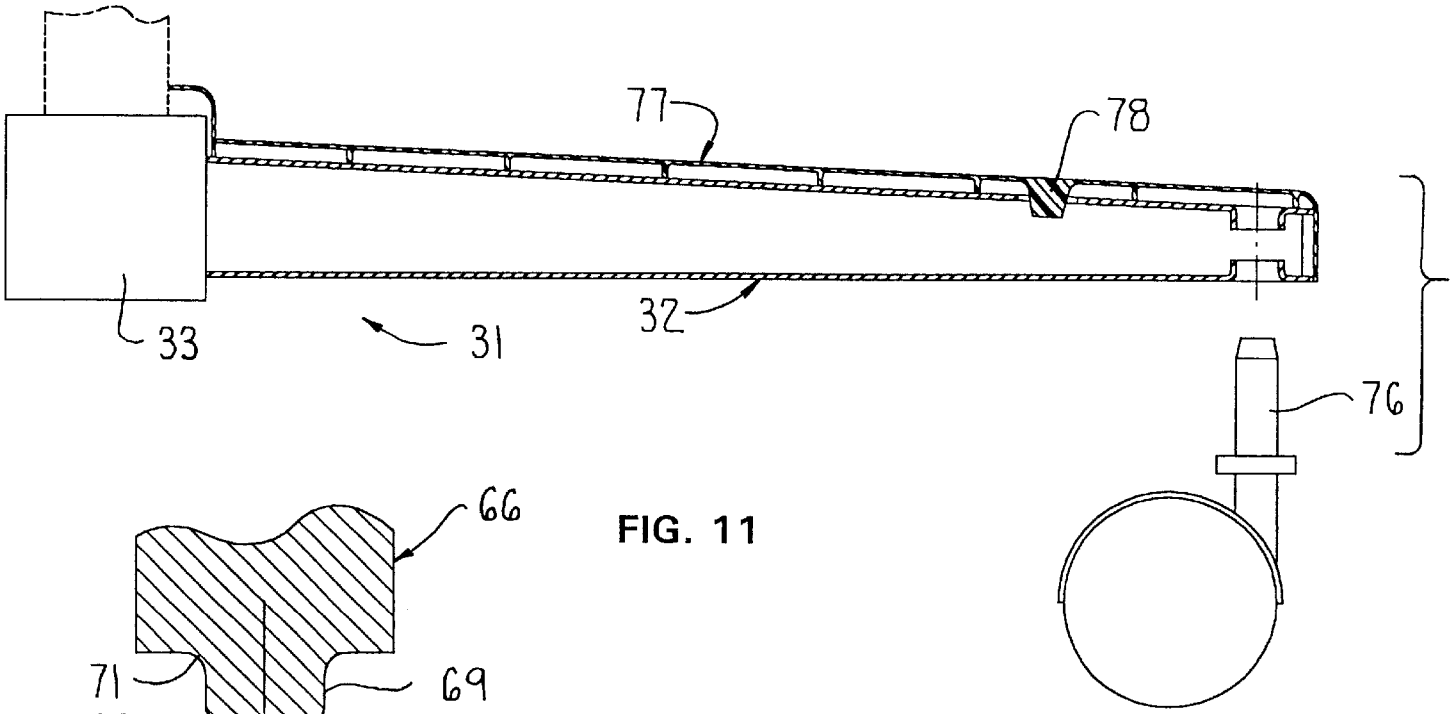
FIG. 11 is a fragmentary side elevational view, partially in cross section, and illustrating the manner in which the leg of this invention, when secured to the hub and defining part of the unitary base member, accommodates a conventional caster pintle and a conventional cover.

As also illustrated by FIG. 11, a conventional cover 77 can be provided so as to effectively enclose the upper, side and ends of each chair leg 32, and to also partially or circumferentially surround part of the center hub, such covers being conventional and designed in accordance with the overall desired chair construction and aesthetics. The cover typically has, associated with the leg portion of the cover, a lug 78 which projects through the opening 46 formed in the top wall of the leg member to permit securement of the cover to the leg member 32.

With the arrangement thus illustrated and described, each leg member 32 is defined as a unitary, one-piece, integral, monolithic member having the caster-pintle support structure or hub arrangement 51 associated therewith, thereby obviating the need for a separate support sleeve for the caster pintle, or obviating the need to weld the caster pintle to the base leg. The entire unitary base member 31 can thus be manufactured in its entirety from a minimal number of parts. For example, for a conventional five-leg base member, the base member 31 requires only six parts, namely a center hub 33 and five identical leg members 32. The overall process for manufacture of the base member 31, as briefly summarized below, is significantly simplified, thereby resulting in a unitary base member which provides significant cost efficiencies with respect to manufacture thereof, but which at the same time provides the strength, durability and caster-accommodating ability as required for chairs of this type.

The forming of the leg member 32 of the present invention, and the forming of the rigid unitary base member 31, in accordance with preferred and alternative processes, will now be briefly described.

The flat platelike blank 34 is initially formed, such as in a stamping press, by being separated from a larger piece of platelike steel material. The blank 34 is then subjected to a forming operation, such as in a stamping press, to effect bending of the flat blank 34 about the fold lines 35 so as to effectively create the closed tubular configuration of the leg member. During this latter stamping or folding operation, the opposed side edges 47–48 are moved into tight abutting engagement with one another, whereupon the opposed notches 45 and teeth 44 effectively snugly interfit to assist in preventing separation of the opposed edges. With this construction, it is contemplated that welding the edges 47–48 together will not be required. However, due to transverse torsional loads applied by the caster stem adjacent the free end of the leg 32, the opposed edges 47–48 may be secured by a single spot weld, such as indicated at 49 in FIG. 3, as located between the free edges 47–48 adjacent the free end of the leg. This spot weld 49 is sufficient to provide adequate strength redundancy as to prevent any inadvertent torsional separation between the abutting edges 47–48.

After the blank has been stamped to define the closed tubular leg configuration as discussed above, the leg is further processed, preferably by two sequential pierce-and-extrude operations so as to permit sequential forming of the hub parts 61. The leg member 32 is positioned in a forming press and the opposed halves 81–82 (FIG. 10) of a inner die tool are inserted into the interior of the leg member from opposite ends thereof until the opposed die halves 81–82 effectively abut one another at the desired position within the leg member to define an interior cylindrical guide bore 83. This latter bore is generally aligned with the forming tool 66. The tool 66 is formed with a pierce or punch on the free end so as to sequentially pierce and thereafter extrude a portion of the wall of the leg member. As the forming tool 66 is moved into engagement with one of the top and bottom walls of the leg member, the leading or punch end of the tool 66 initially effects forming of the pilot hole and then the latter acts as a guide for guiding insertion of the flared tapered portion 68 of the tool as the latter moves transversely inwardly toward the leg member. The inward movement of the forming tool continues so as to cause the annular band of wall material 58 to be deformed, that is, extruded, inwardly initially around the flared conical forming surface 68 and thereafter around the exterior cylindrical forming surface 69, with the cylindrical shaping of the hub part also being assisted by the surrounding confinement provided by the inner cylindrical wall 83 as defined by the interior die halves 81–82.

After one of the hub parts 61 has been extruded so as to have the desired configuration, then the leg member is again fixtured in a forming press, preferably with the leg member being fixtured on an alignment pin which seats in the first-formed hub part, which alignment pin is also disposed in opposed aligned relationship with a further forming tool 66 corresponding to the first-mentioned pierce-and-extrude tool 66 as described above. The support anvil or die 81–82 is again positioned interiorly of the leg member in supportive engagement between the upper and lower walls and in surrounding relationship to the hub part previously formed. The other forming tool is then moved transversely toward the leg to hence engage the other of the top and bottom walls, thereby sequentially causing first piercing of the pilot opening and thereafter extrusion of the surrounding annular wall material 58 until the latter is extruded into a further cylindrical hub part 61 which is cantilevered inwardly so as to be coaxially aligned with but spaced from the previously extruded hub part. The forming tool is then removed, and the leg is removed from the tooling for subsequent utilization.

If desired, after the two hub parts 61 have been formed as described above, the leg member can again be fixtured in a suitable tool, and a sizing and aligning step carried out by means of inserting a tool, such as a punch or reamer, through the aligned hub parts 61 so as to effect final precise sizing and aligning thereof. The latter sizing and aligning step is optional, however, and is not believed essential if the pierce-and-extrude steps are carried out after the blank has been formed into the elongate tubular shape.

As a first alternative to the above process, the coaxially opposed upper and lower hub parts 61 can be simultaneously pierced-and-punched by means of opposed forming tools which move simultaneously into engagement with the opposed top and bottom walls of the tubular leg member. The simultaneous pierce-and-extruding of the two hub parts, however, may make maintaining of alignment somewhat more difficult, and imposes additional restrictions with respect to the sizing and displacing of the forming tools.

As a further process alternative, the flat blank 34 can be initially stamped into a generally U-shaped channel, and during this forming step the piercing and extruding of the hub part associated with the bight of the U-shaped channel can be carried out. The U-shaped partially formed leg blank is then subjected to a further stamping operation which effects forming of the partially formed leg blank into the closed tubular configuration, and also effects piercing and extruding of the other hub part as associated with the top wall of the tubular leg member.

As a still further alternative, the piercing and extruding of the two hub parts can each be carried out, either sequentially or simultaneously, when the blank 34 is in its flat condition. This latter process may present greater inaccuracies with respect to alignment of the hub parts when the blank is folded into the tubular configuration, and thus a subsequent sizing and aligning processing step may be required.

When carrying out the forming process according to the alternatives discussed above, it will be appreciated that the piercing or forming of the pilot hole can be carried out by a first tool, and the extruding carried out by a second tool, although use of a single tool for sequentially carrying out the piercing and extruding steps is preferred.

With the process of this invention as summarized above, the individual leg members 32, each being a rigid, monolithic, one-piece structure having a caster pintle retaining hub associated integrally and monolithically with the free end thereof, can be initially manufactured so as to facilitate both the manufacture, handling and shipment thereof. The thus formed leg members can thereafter be positioned for cooperation with a center hub and welded thereto so as to define the rigid unitary base member 31.

While the chair leg member has been described above for use in association with a chair base member of the type having five elongate legs radiating outwardly in generally horizontal fashion from a center hub, it will be appreciated that the chair leg of this invention can be used in conjunction with base members which utilize less than or greater numbers of radiating legs, or base members wherein the legs radiate at different horizontal and/or vertical relationships from a supporting hub, or where the leg members are provided with a different configuration over the length thereof so as to permit attachment to a different type of frame.

It will further be recognized that the forming steps and forming tools which are briefly and diagrammatically illustrated herein may assume many other conventional variations or configurations while still permitting carrying out of the invention disclosed herein so as to result in the improved chair leg of this invention.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A process for forming a rigid unitary chair base, comprising the steps of:

providing an elongate tubular leg member having spaced top and bottom walls; and extruding said top and bottom walls, adjacent one end of said leg member to form respective top and bottom annular hubs which open through the respective top and bottom walls and are cantilevered interiorly of the leg member in opposed and generally coaxially aligned relationship so as to define a pintle-receiving bore which extends vertically through the leg member for directly supportingly engaging a caster pintle.

2. A process according to claim 1, including the step of forming through each of said top and bottom walls a small pilot opening, and thereafter extruding an annular band of wall material surrounding the respective pilot opening transversely relative to the respective wall so as to permit forming of the respective annular hub.

3. A process according to claim 2, including the steps of: providing a flat, one-piece, sheet-like steel blank, and thereafter deforming the blank to define the elongate tubular leg member.

4. A process according to claim 3, wherein at least one of the top and bottom annular hubs is extruded prior to the blank being fully formed into a tubular configuration.

5. A process according to claim 1, including th steps of:

providing a plurality of substantially identical tubular leg members each having said pintle-receiving bore defined therein;

positioning said plurality of leg members in angularly spaced relationship around and radiating outwardly from a center hub so that inner ends of the leg members are disposed adjacent the hub and the pintle-receiving bores are disposed adjacent the free ends of the leg members; and welding the inner ends of the leg members to the hub to define a rigid unitary base member.

6. A process according to claim 2, including the steps of:

providing a flat, one-piece blank of sheet steel having wall parts which define the top, bottom and side walls of the tubular leg member;

deforming the blank so as to define the elongate tubular leg member having top, bottom and side walls defined by the respective said wall parts of the blank;

abutting free side edges of the blank against one another and generally along the top wall of the tubular leg member during the formation thereof;

forming pilot openings through each of the top and bottom walls in the vicinity of said one end; and thereafter extruding said annular hubs from the respective top and bottom walls so as to define the pintle-receiving bore having a diameter which is greater than the cross-section of said pilot openings.

7. A process according to claim 6, wherein opposed abutting side edges of the blank, as they extend longitudinally along the top wall of the formed tubular leg member are provided with interfitting notches and teeth to create a secure abutting engagement between the opposed side edges, and said opposed side edges at said one end of said tubular leg member in close proximity to said annular hubs being fixedly secured by a single spot weld.

8. A method of making a leg member of a chair base said method comprising:

deforming a flat, one-piece blank into an elongate tubular leg having top, bottom and side walls; and deforming each of said top and bottom walls to form top and bottom hubs which respectively project into the interior of said leg and are oriented in generally opposed and aligned relation with one another, said top and bottom hubs together defining a bore for mounting therein a stem of a caster.

9. A method according to claim 8, further including forming an opening in each of said top and bottom walls adjacent one end of said leg, and thereafter deforming an annular area of leg material surrounding the respective opening to form the respective hub.

10. A method according to claim 9 wherein said steps of forming and deforming said annular area in the respective wall are carried out sequentially and with the same forming tool.

11. A method according to claim 9 wherein said steps of forming and deforming said annular area in the respective wall are carried out sequentially and with different forming tools.

12. A method according to claim 9 wherein said openings in said top and bottom walls are generally coaxially aligned with one another along a common vertical axis, and said step of deforming said annular area is carried out with a forming tool which is inserted into the respective opening and then moved relative to the leg along the axis so as to transversely deform the annular area of leg material into the interior of the leg to form the respective hub.

* * * * *